US009523251B2

(12) United States Patent
Honekamp

(10) Patent No.: US 9,523,251 B2
(45) Date of Patent: Dec. 20, 2016

(54) APPARATUS AND METHODS FOR PERFORMING DOWNHOLE OPERATIONS USING A SELECTABLY OPERABLE MOTOR

(71) Applicant: Jacob R. Honekamp, Del City, OK (US)

(72) Inventor: Jacob R. Honekamp, Del City, OK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 687 days.

(21) Appl. No.: 13/949,960

(22) Filed: Jul. 24, 2013

(65) Prior Publication Data

US 2015/0027708 A1 Jan. 29, 2015

(51) Int. Cl.

| | |
|---|---|
| ***E21B 21/10*** | (2006.01) |
| ***E21B 23/04*** | (2006.01) |
| ***E21B 29/06*** | (2006.01) |
| ***E21B 4/02*** | (2006.01) |
| *E21B 34/06* | (2006.01) |

(52) U.S. Cl.

CPC ..... *E21B 21/103* (2013.01); *E21B 4/02* (2013.01); *E21B 21/10* (2013.01); *E21B 23/04* (2013.01); *E21B 29/06* (2013.01); *E21B 34/06* (2013.01)

(58) Field of Classification Search

CPC ..... E21B 4/02; E21B 21/10; E21B 21/103; E21B 29/06; E21B 23/04

See application file for complete search history.

(56) References Cited

U.S. PATENT DOCUMENTS

| | | | | |
|---|---|---|---|---|
| 5,443,129 | A * | 8/1995 | Bailey | E21B 7/061 166/117.6 |
| 5,535,835 | A * | 7/1996 | Walker | E21B 7/067 175/107 |
| 6,289,998 | B1 | 9/2001 | Krueger et al. | |
| 7,152,698 | B2 | 12/2006 | Dewey | |
| 8,469,104 | B2 * | 6/2013 | Downton | E21B 4/02 166/330 |
| 2004/0089480 | A1 * | 5/2004 | Dewey | E21B 4/02 175/107 |
| 2005/0126828 | A1 * | 6/2005 | Pinol | E21B 4/02 175/92 |
| 2006/0243493 | A1 | 11/2006 | El-Rayes et al. | |
| 2012/0193145 | A1 | 8/2012 | Anderson | |

OTHER PUBLICATIONS

PCT International Search Report and Written Opinion; International Application No. PCT/US2014042527; International Filing Date: Jun. 16, 2014; Date of Mailing: Oct. 21, 2014, pp. 1-12.

* cited by examiner

*Primary Examiner* — David Andrews
*Assistant Examiner* — Tara Schimpf
(74) *Attorney, Agent, or Firm* — Cantor Colburn LLP

(57) ABSTRACT

In one aspect an apparatus for performing a downhole operation is disclosed that in one non-limiting embodiment may include a downhole tool that contains a hydraulically-operated motor and a flow control device that in one position allows a fluid to pass through the motor while preventing the fluid to flow to the motor and in another position allows the fluid to flow to the motor to operate the motor.

20 Claims, 3 Drawing Sheets

APPARATUS AND METHODS FOR PERFORMING DOWNHOLE OPERATIONS USING A SELECTABLY OPERABLE MOTOR

BACKGROUND OF THE DISCLOSURE

1. Field of the Disclosure

The present disclosure relates generally to performing a drilling and/or milling operation in a wellbore using a drill or mill operated by a hydraulically-operated motor.

2. Description of the Related Art

Many operations in wellbores for recovery of hydrocarbons (oil and gas) include milling a portion of a casing in the wellbore or forming a lateral wellbore from a main cased or open wellbore. Windows are milled or cut the side wells are formed from specified locations in the main wellbore. To perform such a milling or cutting operation during a single trip, a string containing a downhole tool (also referred to as the bottomhole assembly "BHA") at a bottom end of a tubing, such as drill pipe or a coiled tubing, is conveyed in the wellbore that includes a cutting tool, such as a mill or drill, connected to a bottom end of a rotor of a fluid-operated motor, such as a progressive cavity motor, a whipstock connected to the mill or a body of the tool proximate the mill and an anchor below the whipstock. The whipstock is first oriented in the wellbore. The rotor of the motor is typically mechanically locked to prevent it from rotating the cutting tool and thus the whipstock. Once the whipstock has been oriented, the anchor attached below the whipstock is hydraulically set by flowing fluid through the locked motor and without breaking the mechanism locking the rotor in its locked position. After the anchor and whipstock have been set, the cutting device is mechanically disengaged from the whipstock, such as pulling or jarring the string or by hydraulically breaking the connection by supplying fluid to the motor above a threshold pressure. The cutting device is then lowered along the sliding side of the whipstock to perform the milling operation.

The disclosure herein provides downhole apparatus and methods that include a hydraulically-operated motor that is prevented from rotation while allowing a fluid to flow through a fluid passage in rotor to hydraulically set the anchor then blocking the fluid through the rotor and flowing the fluid to the motor to operate the motor to perform a milling/cutting operation by operating the motor.

SUMMARY

In one aspect, an apparatus for performing a downhole operation is disclosed that in one non-limiting embodiment may include a downhole tool that contains a hydraulically-operated motor and a flow control device in fluid communication with the motor, wherein the flow control device in one position allows a fluid to pass through the motor while preventing the fluid to flow to the motor and in another position allows the fluid to flow to the motor to operate the motor.

In another aspect, an apparatus for performing a downhole operation is disclosed that in one non-limiting embodiment may include a tool that contains a cutting device, a fluid-operated motor that rotates the cutting device, a whipstock connected and an anchor and a flow control device, wherein the flow control device in one position allows a fluid to pass through the motor while preventing the fluid to flow to the motor and in another position allows the fluid to flow to the motor to operate the motor.

In another aspect, a method of performing a downhole operation is disclosed that in one non-limiting embodiment may include: conveying a downhole tool in the wellbore that includes a whipstock detachably connected to a tool member, an anchor connected to the whipstock, a fluid-operated motor that rotates a cutting device, wherein the motor includes a rotor having a fluid flow path therethrough; orienting the whipstock to a selected orientation; supplying a fluid at first flow rate to flow the fluid through the rotor while preventing the fluid to flow to the motor to operate the motor; setting the anchor in the wellbore with the fluid flowing through the motor; supplying the fluid at a second flow rate to flow the fluid to the motor to operate the motor to operate the cutting device; and performing the downhole operation with the cutting device.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DRAWINGS

Figure 1:
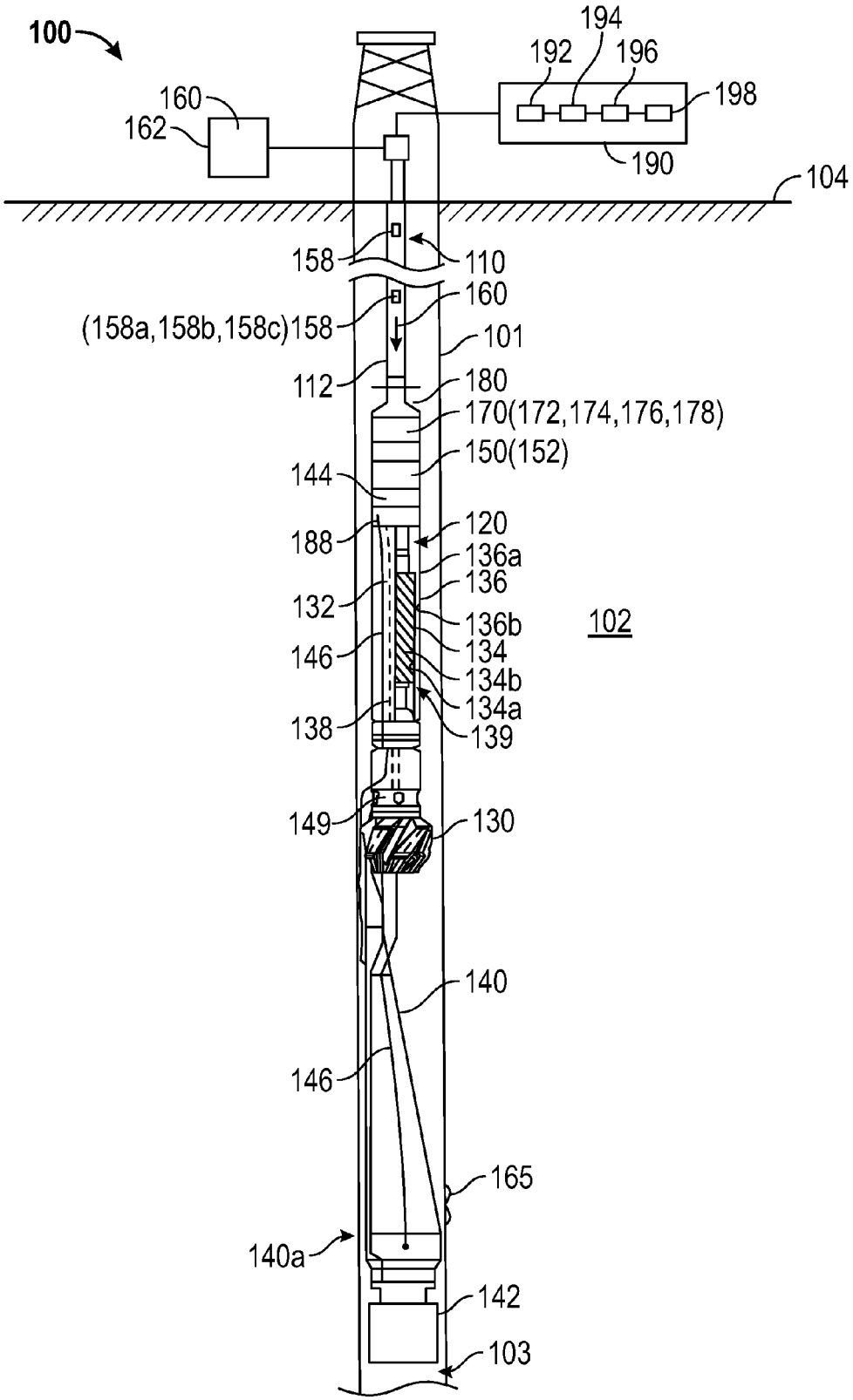
FIG. 1 is a schematic diagram of an exemplary drilling system with a downhole tool conveyed in a wellbore, wherein the downhole tool includes a whipstock, an anchor, a cutting device and a fluid-operated motor for operating the cutting device, according to one embodiment of the disclosure.

FIG. 1 is a schematic diagram of an exemplary system 100 for performing a milling/cutting operation in a wellbore 101 formed in a formation 102. A drill string 110 is shown conveyed from a surface location 104 into the wellbore 101 to a desired depth 103. In aspects, the drill string 110 includes a downhole tool or assembly (also referred as a bottomhole assembly or "BHA") 120 conveyed in the wellbore by a conveying member 112, such as a coiled tubing or a drill pipe (a tubular). The downhole tool 120 includes a cutting device 130, such as a mill or a drill bit connected to a fluid-operated motor 132, such as a progressive cavity motor. The motor 132 rotates the bit 130 when a fluid 160 under pressure is pumped from a storage unit 162 at the surface 104 into the tubular 112. The fluid 160 rotates the motor 132 that, in turn, rotates the bit 130. The downhole tool 120 further includes a detachable whipstock 140 connected to the drill bit 130 or at another suitable location on the downhole tool above (uphole) the drill bit 130. An anchor 142 is connected below the whipstock 140. In aspects, the anchor 142 may be a hydraulically set packer or another suitable device. In one aspect, the motor 132 includes a rotor 134 inside a stator 136. The rotor 134 includes a number of lobes 134*a* on its outer surface 134*b* and the stator 136 includes lobes 136*a* on its inner surface 136*b*. The lobes of the rotor and stator form a number of progressive cavities 139, depending upon the number lobes and the lobe pitch. The rotor 134 rotates when the fluid 160 is supplied under pressure to the motor 132, i.e., between the rotor and the stator to the progressive cavities 139. The construction and operation of such motors is known in the art and is thus not described in detail herein. In one non-limiting embodiment, the rotor 134 includes a through fluid passage or bore 138 that allows the fluid 160 to flow through the passage 138 and then to the drill bit 130. In one non-limiting embodiment, a hydraulic control sub 144 above the rotor 134 may be utilized to control the supply of the fluid to the motor 132 to selectively operate the motor 132. A fluid line 146 may be provided to allow the fluid from the flow through passage to flow to the anchor to set the anchor. Thus, in such a configuration, when the fluid flow passage 138 is open, the fluid 160 will pass through the flow through passage 138 into the fluid line 146. The fluid supplied above a selected or threshold pressure to line 146 causes the anchor 142 to expand and set (or anchor) in the wellbore 101. The downhole tool 120 further includes a fluid flow device or a flow control device 188 above or uphole of the rotor 134. In one aspect, the flow control device 188 may be a sub that may be placed or connected above the flow passage 138 in the rotor 134. In one configuration, the flow control device 188 in an open position blocks the fluid 160 to flow to the motor, i.e., to the cavities between the rotor 134 and the stator 136, thereby preventing the rotor 134 from rotating, while allowing the fluid 160 to flow through the flow passage 138 in the rotor 134. In a closed position, the flow control device 188 allows the fluid 160 to flow to the motor cavities, thereby allowing the rotor to rotate, while blocking the fluid 160 from passing through the flow passage 138 in the rotor, as explained in detail in reference to FIGS. 2-3.

Still referring to FIG. 1, the downhole tool 120 further includes an orientation device 150 that may include one or more magnetometers and accelerometers and other suitable sensors (collectively referred to as orientation sensors and designated by numeral 152). The orientation sensors 152 provide measurements relating to the orientation (such as the tool face) of the downhole tool 120 and thus the orientation of the whipstock 140 that is securely attached to the tool 120. A downhole controller 170 processes the signals from the sensors 152 in the orientation device 150 and transmits the processed signals to a surface controller 190 via a telemetry unit 180, which may be a wireless transmitter. In one embodiment, the downhole controller 170 includes an electric circuit 172 that preprocesses (for example, amplifies) signals from sensors 152, a processor 174, such as microprocessor, that further processes signals from circuit 172 and transmits the processed signals to the surface controller 190 via the wireless telemetry unit 180. The controller 170 may further include a memory device 176, such as a solid state memory, that stores data and programmed instruction 178 accessible to the processor for processing the signals and performing one or more downhole operations. Similarly, the surface controller 190 may include a circuit 192 that receives and conditions signals transmitted by the device 180, a processor 194, a memory device 196 and programmed instructions 198. In one embodiment, the telemetry unit 180, in one embodiment, may include an acoustic transmitter, such as a piezoelectric transmitter or a bender-bar acoustic transmitter. In another aspect, the wireless telemetry unit 180 may include an electromagnetic wave transmitter that induces electromagnetic waves along an outside of the tubular 112.

In operation, in one non-limiting embodiment, sensors 152 send measurement signals to the controller 170, which processes the sensor signals and sends the processed signals to the surface controller 190 via the telemetry device 180. The surface controller 190 determines the orientation of the downhole tool 120 from the received signals. One or more repeaters 158 may be provided along the drill string. The number and spacing of the repeaters 158 depend upon the wellbore depth and the attenuation of the transmitted signals. Each repeater 158 may include a receiver 158*a* that receives the transmitted wireless signals, an amplifier 158*b* that amplifies such received signals and a transmitter 158*c* that transmits the amplified signals. A common transceiver may be used both as the transmitter and the receiver in each repeater. The repeater components may be powered by battery pack.

To perform a downhole operation, such as to mill a window in the casing or drill a side hole in the wellbore 101 at location 165, the downhole tool 120 is conveyed into the wellbore 101 to the depth 103 so that the lower end 140*a* of the whipstock 140 is so positioned that the bit 130 will cut the hole at the location 165. The controller 170 processes the signals from the orientation sensors 152 and sends the processed signals to the surface controller 190 via the wireless telemetry device 180 and the repeaters 158, if used. The surface controller 190 determines the orientation of the downhole tool 120 and thus the orientation of the whipstock 140 because the whipstock location relative to a location on the tool 120 is known. The whipstock 140 is oriented along a desired direction based on the determined orientation of the tool 120 as determined by the controller 190. In one aspect, the whipstock may be oriented by applying right hand rotation of the drill pipe. The right hand rotation at the surface is transmitted downhole and the orientation device reads the change in position relative to the wellbore thus determining the orientation of the whipstock face. In a coiled tubing application, the orientation of the whipstock 140 through surface manipulations cannot be done due to the inability of coiled tubing to rotate. In such a case, the orientation of the whipstock face can be a fixed orientation relative to the wellbore. The orientation of the whipstock may be monitored and confirmed by continually processing the orientation sensor 152 signals. In aspects, the downhole controller 170 and/or the surface controller 190 may be programmed to determine the whipstock orientation before, during and after setting the anchor 142.

Still referring to FIG. 1, once the whipstock has been oriented, the anchor 142 is set in the wellbore 101. As described above, the flow control device 188 initially is in the open position. To set the anchor 142, the fluid 160, either controlled from the surface 104 or by the device 144, is then supplied under a first lower pressure to the flow control device 188, which device allows the fluid 160 to flow through the passage 138 in the rotor 132 but prevents the fluid 160 from flowing to the motor cavities, thereby preventing rotation of the rotor 132 and thus the rotation of drill bit 130. The fluid 160 flowing through the rotor passage 138 flows to the anchor 142 via fluid line 146, which sets the anchor 142 inside the wellbore 101. After setting the anchor 142, the whipstock 140 is disengaged from the bit 130 by pulling or pushing the tool 120 and breaking the mechanical connection 149 between the whipstock 140 and the downhole tool 120. The downhole tool 120 is then moved downhole along the whipstock 140 to allow the drill bit 130 to contact the wellbore at location 165. The fluid 160 is then supplied to the flow control device at a second higher pressure, which is greater than the first. The second pressure is sufficient to cause the flow control device 188 to switch or move from the open position to the closed position. As described above and in more detail below in reference to FIGS. 2-3, in the closed position, the flow control device 188 closes the flow passage 138 and allows the fluid to flow to the motor cavities. The pressure of the supplied fluid is adjusted to the pressure to rotate the rotor at a desired rotational speed for performing the milling operation at location 165.

In the downhole tool 120 embodiment shown in FIG. 1, the motor 132 conveyed downhole with the flow control device 188 therein remains in an inoperable mode (also referred herein as the "open position") because the fluid is blocked from flowing to the progressive cavities 139 of the motor 132. The operation of the motor can be selectively controlled by adjusting the pressure of the fluid 160 supplied to the motor 132. Thus, orienting the whipstock 140, setting of the anchor 142 and performing a downhole operation with the mill 130 can be accomplished during a single trip of the downhole assembly 120 in the wellbore 101.

Figure 2:
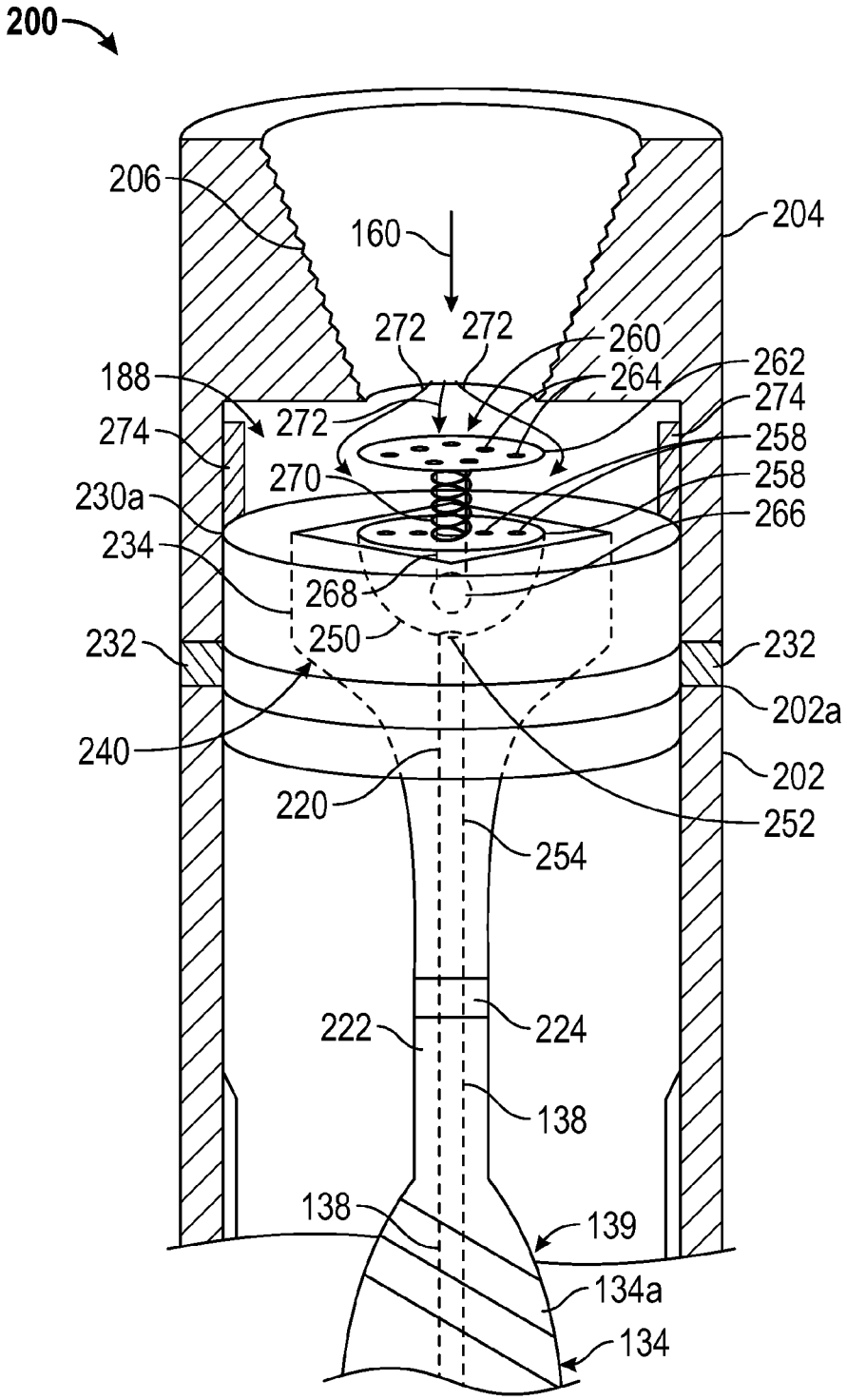
FIG. 2 is a schematic diagram of a flow control device in an open position to block a fluid supplied to the motor to flow to the motor and allow the fluid to pass through the motor.

FIG. 2 is a line diagram of a subassembly (also referred to herein as "top sub") 200 that includes a flow control device 188 (FIG. 1), according to one non-limiting embodiment of the disclosure. The top sub 200 includes a body 202 that has an upper box end 204 having internal threads 206 for attaching the top sub 200 to a threaded member (not shown) of the BHA 120 (FIG. 1). The flow control device 188 is shown placed below the box end 204. The flow control device 188 includes a flow passage 220 in fluid communication with the flow passage 138 of the motor 132. In one configuration, the flow control device 188 may be coupled to a rod member 222 extending from the rotor 134 of the motor 132. In one aspect, the flow control device 188 may be connected to the rod member 222 via a suitable mechanical connection or joint 224. In another aspect, the rod member 222 may be integral to the flow control device 188.

In an aspect, the flow control device 188 includes a locking plate 230 securely held inside the body 202 by attachment members, such as shearable screws 232, at a first location 202*a* in the body 202. Keys 274 may be provided inside the body 202 to hold the top end 230*a* of the locking plate 230 in position. The locking plate 230 does not move all the way up on the keys 274. The locking plate 230 slides down inside the body 202 when the screws 232 are sheared as described in more detail in reference to FIG. 3. The locking plate 230 has a hollow inside 234 that houses a flow restriction member 240 (also referred to herein as "anchor"). The flow restriction member 240 has a cavity 250 that has a top opening 258 and a bottom opening 252 coupled to flow passage 254 that provides fluid communication between the cavity 250 and fluid flow path 138 in the rotor 134. A flow closure member, such as poppet 260 (shown in open position), is provided to selectively close the fluid passage 254. In one aspect, the poppet 260 may include a closing plate or "plate" 262 and a ball member 266 connected to the plate 262 via a rod member 268. The closing plate 262 may include perforations 264. The poppet 260 is held in the open position, as shown in FIG. 2, by a biasing member, such as a spring 270. When the flow control device 188 in the top sub 200 is assembled on the top of the motor 132, the locking plate 230 is locked in the body 202 at a first or upper location 202*a* with the locking screws 232, while the poppet 260 is the open position, thereby providing a fluid flow path 272 from above the poppet 260 to the flow passage 138 in the rotor via the cavity 250. The flow restriction member 240 outer dimensions conform to the hollow section 234 inner dimensions so that when the flow restriction member 240 is in the hollow section 234 it blocks or substantially blocks the flow of the fluid 160 to the motor 132, i.e., to the progressive cavities 139 in the motor 132 (FIG. 1). Thus, when the poppet is in the open position, the fluid 160 flows around the poppet plate 262, as shown by arrows 272 into the cavity 250 and then to the flow passage 138 of the motor via opening 252 in the cavity 250.

Figure 3:
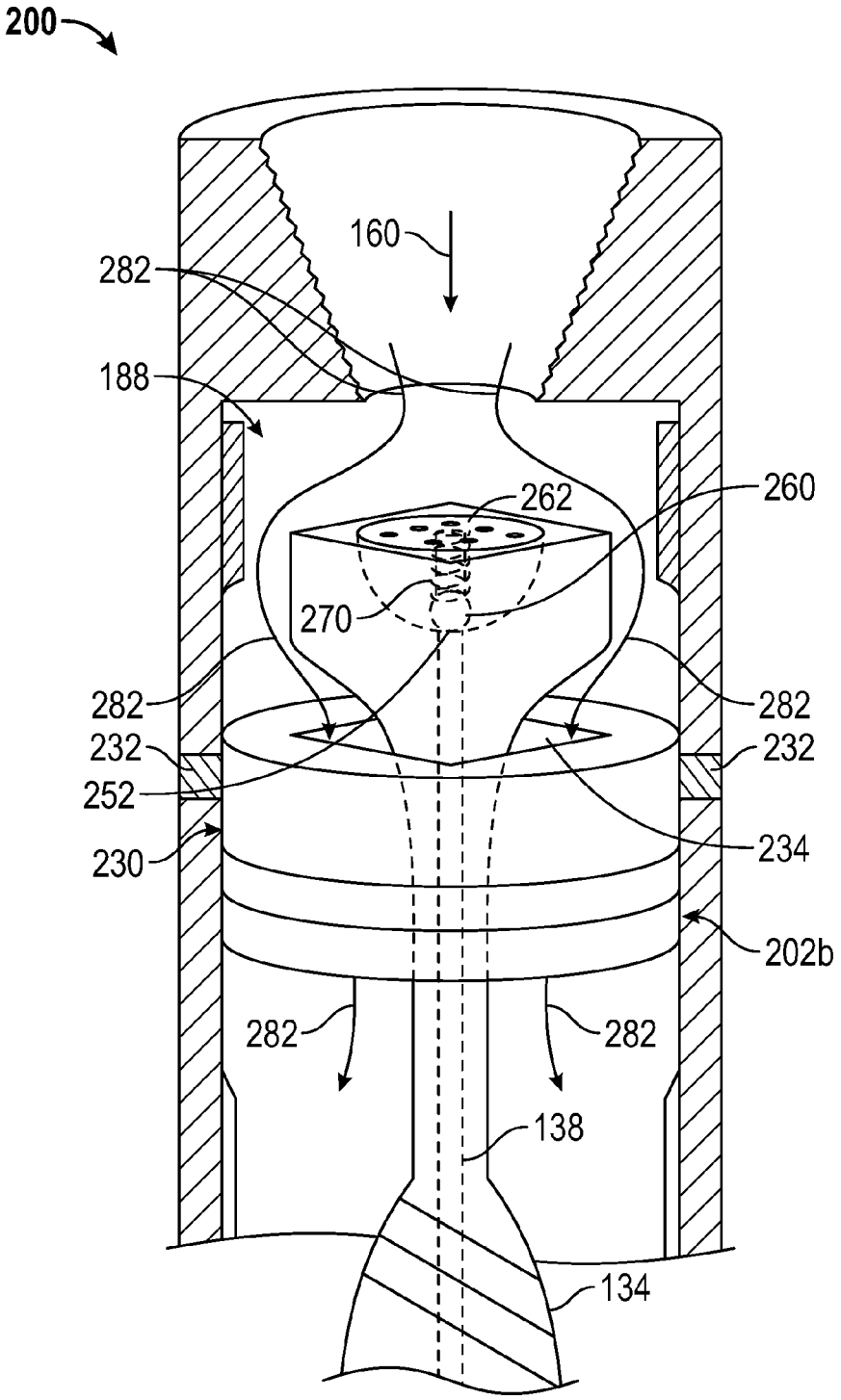
FIG. 3 is a schematic diagram of the flow control device of FIG. 2 in a closed position to allow the fluid supplied to the motor to flow to the motor and prevent the fluid to flow through the motor.

FIG. 3 is a line diagram showing the flow control device 188 in the closed position. The operation of the flow control device 188 is now described while referring to both FIGS. 1-3. To set the anchor 142 in the well, the fluid 160 is supplied from the surface at first or initial pressure or flow rate. This first flow rate acting on the plate 262 is not sufficient to overcome the biasing member 270, which allows the poppet 260 to remain in the open position as shown in FIG. 2, which allows the fluid 160 to pass through the flow control device 188 to the flow passage 138 in the rotor 134 and then to the bottom of the bit 130. The first flow rate, however, is sufficient to set the anchor 140 in the wellbore 101, as described in reference to FIG. 1 above. Once the anchor 140 has been set, the flow rate of the fluid 160 is increased to a second flow rate, which flow rate acting on the plate 262 is sufficient to overcome the tension in the biasing member 270, which compresses the biasing member 270 and causes the ball 266 to move downward and close the opening 252, blocking the fluid 160 from flowing through the fluid passage 138 in the rotor 134. If the second flow rate is not sufficient to shear the screws 232, it may be increased further to apply sufficient pressure on the locking plate 230 to cause it to shear the shear screws 232. Shearing the screws 232 causes the locking plate 230 to move downward to a second position 202*b* in the body 202, as shown in FIG. 3. Moving the locking plate 230 downward, causes the fluid 160 to flow through the hollow opening 234 in the locking plate 230 and then to the cavities 139 in the motor 132, as shown by arrows 282, which in turn causes the rotor 134 to rotate and operate the drill bit 130. Thus in the closed position, the flow control device 188 allows the fluid supplied from the surface to flow to the motor, while blocking the fluid to pass through the rotor 132. Thus, the downhole tool 120 in one mode allows setting of the anchor 142, while the motor 132 remains in a locked or inoperable mode and in another mode allows the motor 132 to operate in normal fashion. These modes are obtained by selectively controlling the flow rate or pressure of the fluid 160 supplied to the motor in the tool 120, which enables the tool 120 to orient the whipstock, set the anchor and perform a downhole operation during a single trip of the tool 120 into the wellbore 101.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A downhole tool for performing an operation in a wellbore, comprising:

a fluid-operated motor having a rotor inside a stator, the rotor having a fluid flow path therethrough; and a flow control device above the rotor that in a first position allows a fluid supplied to the motor to pass through the fluid flow path in the rotor and blocks the fluid from flowing through a cavity between the stator and the rotor to prevent the rotor from rotating and in a second position allows the fluid to flow through the cavity between the stator and the rotor to cause the rotor to rotate, wherein a fluid pressure applied to the flow control device above a selected value moves the flow control device from the first position to the second position.

2. The downhole tool of claim 1 further comprising a drill bit coupled to the rotor and a whipstock and an anchor below the drill bit.

3. The downhole tool of claim 2 further comprising a fluid flow line for supplying a fluid to the anchor for setting the anchor in the wellbore.

4. The downhole tool of claim 1, wherein the flow control device comprises:

a locking plate having a cavity, the locking plate being secured at a first location in a body of the downhole tool; and a poppet configured to move between an open position and a closed position in the cavity.

5. The downhole tool of claim 4, wherein the poppet remains in the open position when the fluid pressure is applied onto the poppet below the selected value and moves into the closed position when the fluid pressure is applied onto the poppet above the selected value.

6. The downhole tool of claim 5, wherein the poppet in the open position allows the fluid to flow through the fluid flow passage in the rotor and blocks the fluid from flowing through the cavity between the stator and the rotor and in the closed position allows the fluid to flow through the cavity between the stator and the rotor to enable the motor to operate.

7. The downhole tool of claim 4, wherein the poppet includes a plate and a closing member and wherein pressure applied on the plate above the selected value moves the poppet from the open position to the closed position.

8. The downhole tool of claim 4, wherein pressure applied on the poppet above a selected value causes the locking plate to move from the first position to a second position in the body to open a fluid flow path from above the flow control device to the motor.

9. The downhole tool of claim 1, wherein the flow control device comprises:

a locking plate having a cavity in fluid communication with the fluid path in the rotor, wherein the locking plate in the first position blocks flow of the fluid from above the flow control device to the motor and in a second position allows the fluid to flow to the motor.

10. The downhole tool of claim 9, wherein:

the locking plate is secured in the first position by shearable members that break when pressure above a selected value is applied onto the locking plate.

11. The downhole tool of claim 10 further comprising a poppet that in an open position allows the cavity to remain in fluid communication with the fluid flow path in the rotor and in a closed position blocks fluid communication between the cavity and the fluid flow path in the rotor.

12. An apparatus for performing a downhole operation, comprising:

a tool that includes a hydraulically-operated motor having a rotor inside a stator, the rotor having a fluid flow path therethrough; and a flow control device that in first position allows a fluid to pass through the fluid flow path while preventing the fluid to flow through a cavity between the stator and the rotor and in a second position allows the fluid to flow through the cavity between the stator and the rotor to operate the motor, wherein a fluid pressure applied to the flow control device above a selected value moves the flow control device from the first position to the second position.

13. The apparatus of claim 12 further comprising:

a drill bit operated by the motor;

a whipstock below the drill bit;

an anchor below the whipstock; and and a fluid supply unit that supplies a fluid to the flow control device, wherein the anchor is settable by the fluid flowing through fluid flow path and the drill bit is operable by the fluid flowing through the cavity between the stator and the rotor.

14. A method of performing an operation in a wellbore, comprising:

conveying a downhole tool in the wellbore, the tool including a fluid-operated motor having a rotor inside a stator, the rotor having a fluid flow path therethrough, and a flow control device above the rotor;

flowing a fluid at a first fluid pressure below a selected value to maintain the flow control device in a first position that allows the fluid to flow through the rotor while blocking flow of the fluid through a cavity between the stator and the rotor to prevent the rotor from rotating;

performing an operation in the wellbore using the fluid flowing through the rotor; and flowing the fluid at a second fluid pressure above the selected value to move the flow control device to a second position that allows the fluid to flow through the cavity between the stator and the rotor to rotate the rotor.

15. The method of claim 14 further comprising orienting a whipstock attached to the downhole tool and setting an anchor attached to the whipstock in the wellbore before flowing the fluid to rotate the rotor.

16. The method of claim 15, wherein the downhole tool includes a cutting device that is operated by the rotation of the rotor and wherein the method further comprises performing a milling operation using the cutting device.

17. The method of claim 14, wherein the downhole tool includes a drill bit rotated by the rotor, a whipstock connected to a body of the downhole tool and extending below the drill bit and an anchor below the whipstock, wherein performing an operation in the wellbore includes:

orienting the whipstock in the wellbore;

setting the anchor in the wellbore using the fluid flowing through the rotor;

disconnecting the anchor from the body of the tool; and performing a milling operation with the drill bit by flowing the fluid to the motor.

18. The method of claim 14 further comprising:

flowing the fluid at the second fluid pressure to block the flow of the fluid to the fluid path in the rotor and to cause the fluid to divert to the cavity between the stator and the rotor to operate the motor.

19. The method of claim 14, wherein the flow control device comprises a locking plate that in the first position blocks flow of the fluid from above the flow control device to the motor and in the second position allows the fluid to flow to the motor, wherein the method further comprises:

supplying the fluid to the flow control device at a first rate to enable the locking plate to remain in the first position to set a downhole device;

supplying the fluid to the flow control device at a second rate to move the locking plate to the second position to operate the motor to perform the operation in the wellbore.

20. The method of claim 19, wherein the locking plate is secured in the first position by shearable members that break when the fluid is supplied at the second rate to cause the locking plate to move from the first position to the second position.

* * * * *